US010174492B2

(12) United States Patent
Bush

(10) Patent No.: US 10,174,492 B2
(45) Date of Patent: Jan. 8, 2019

(54) URINAL MIRROR DEVICE WITH BILATERAL CONVEX MIRROR

(71) Applicant: Joseph Bush, Stillwater, MN (US)

(72) Inventor: Joseph Bush, Stillwater, MN (US)

( * ) Notice: Subject to any disclaimer, the term of this patent is extended or adjusted under 35 U.S.C. 154(b) by 0 days.

(21) Appl. No.: 15/392,110

(22) Filed: Dec. 28, 2016

(65) Prior Publication Data

US 2017/0183857 A1 Jun. 29, 2017

Related U.S. Application Data

(60) Provisional application No. 62/271,906, filed on Dec. 28, 2015.

(51) Int. Cl.
*A47K 11/12* (2006.01)
*E03D 13/00* (2006.01)

(52) U.S. Cl.
CPC ..... *E03D 13/005* (2013.01); *A47K 11/12* (2013.01)

(58) Field of Classification Search
CPC ..... E03D 13/00
USPC ..... 4/301–311, 144.1–144.3
See application file for complete search history.

(56) References Cited

U.S. PATENT DOCUMENTS 5,647,074 A * 7/1997 White, Jr. ..... E03D 9/002 4/312
6,470,504 B1 * 10/2002 Neuo ..... E03D 13/00 4/301
6,501,602 B2 * 12/2002 Togino ..... G02B 17/0848 359/631
6,779,206 B1 * 8/2004 Sykes ..... A47K 17/00 4/301
2002/0051299 A1 * 5/2002 Togino ..... G02B 17/0848 359/633
2009/0262323 A1 * 10/2009 Sasaki ..... G03B 27/74 355/68
2016/0185299 A1 * 6/2016 Kawashiri ..... B60R 1/06 362/549

FOREIGN PATENT DOCUMENTS

DE 202005020006 U1 2/2006
JP 2013168857 A 8/2013

* cited by examiner

*Primary Examiner* — Lori Baker
(74) *Attorney, Agent, or Firm* — Kinney & Lange, P.A.

(57) ABSTRACT

A device for aiding an individual in using a urinal includes a housing configured mate with end mount to a flush valve of a urinal, and a bilateral convex mirror mounted in a frame at the front of the housing. The nature of the bilateral curvature of the device prevents individuals standing in close proximity to the user from viewing the users' private regions.

8 Claims, 6 Drawing Sheets

URINAL MIRROR DEVICE WITH BILATERAL CONVEX MIRROR

BACKGROUND

There are individuals, mostly male, that have difficulty in directing a stream of urine to a target such as a toilet or urinal while urinating. There are a number of reasons for this problem including for instance obesity, a physical handicap, or simple over dressing in cold weather. An individual with this handicap may experience embarrassment and shame in the knowledge he is contributing to a messy and unsuitable public and private health problem.

Even a partial solution to this problem would garner wide acceptance.

SUMMARY

A "Privasee" device includes a housing and a bilateral convex mirror that, when mounted on the flush valve of a urinal, provides visual assistance while using a urinal. The device is a rectangular mirror with vertical and horizontal convex curvatures. An optional sensor may be imbedded in the mirror frame as an automatic flush feature. The nature of the bilateral curvature of the device prevents individuals standing in close proximity to the user from viewing the user's private regions. A black finish surrounding the mirror enhances the privacy offered by the device. In an embodiment, the "Privasee" device can be chrome plated to match most plumbing fixtures in the art.

DETAILED DESCRIPTION

"Privasee" is a device comprising a housing containing a bilateral convex mirror that offers a direct, clear and private view of the urination process while using a urinal or flusher toilet. The "Privasee" device is adaptable to all toilet and urinal flushers and offers the user the ability to perform the urination process with improved visual control resulting in a comfortable and much-improved sanitary environment.

Figure 1:
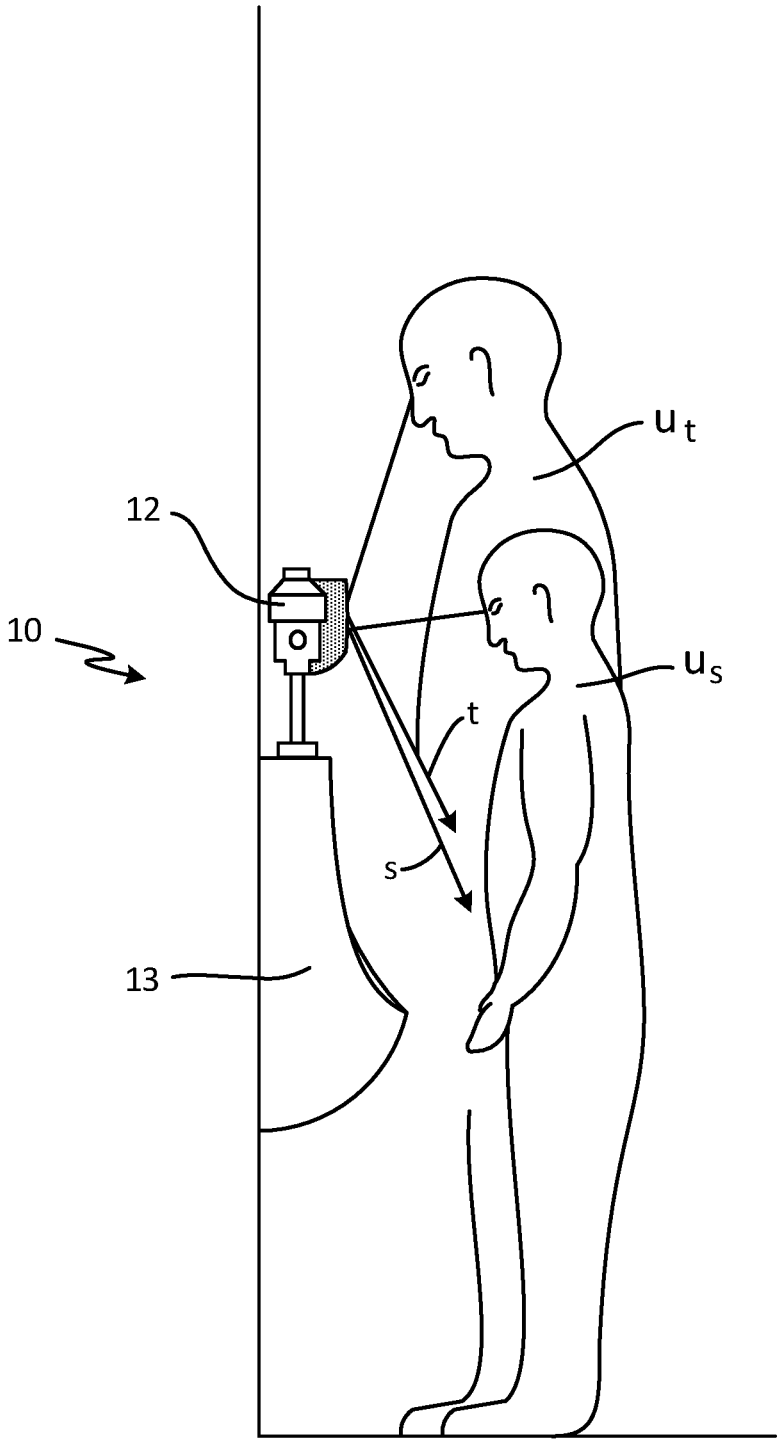
FIG. 1 is a drawing showing the visual experience short and tall users have with the "Privasee" device.

An example of Privasee device 10 mounted on flush valve 12 of a urinal is shown in FIG. 1. As illustrated in FIG. 1, both tall user Ut and short user Us have sight lines that focus on their private regions as indicated by arrows t and s while standing in front of the urinal. The physical height of the user is immaterial and device 10 offers short user Us and tall user Ut the same positive visual experience.

The "Privasee" device 10 is designed to be adapted or added to any plumbing fixture flusher. Public safety is the primary function. "Privasee" device 10 allows an individual toilet or urinal user an extremely clear and private view of the process before, during, and after urination or general toilet use. The device and resulting benefits may prevent the spread of germs improving human health and sanitary conditions of hands, skin, and clothing. Public and private bathrooms in rest areas, theatres, retail stores, gas stations, banks, office buildings, manufacturing facilities, airports, airplanes, and most of all food processing facilities are targeted sites for installation.

"Privasee" device 10 allows otherwise able bodied and, more importantly, unable bodied users such as, obese, arthritic, limb impaired, elderly, young, mentally challenged, and handicapped individuals to enjoy a safe and sanitary experience when using a urinal.

Figure 2A:
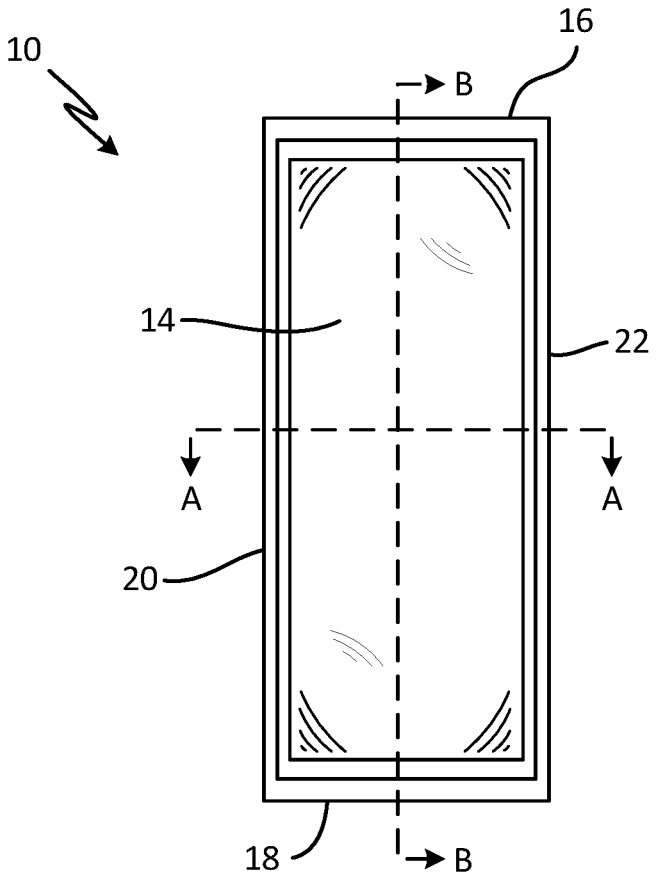
FIG. 2A is a front view of the device.
Figure 2B:
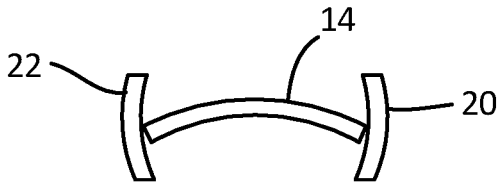
FIG. 2B is cross-section AA of the device.
Figure 2C:
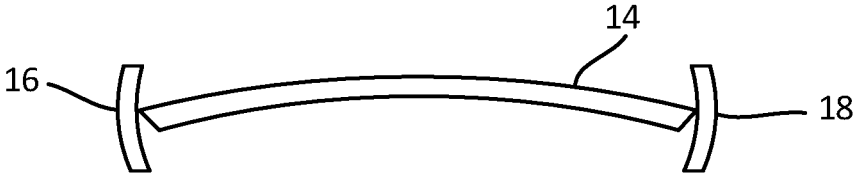
FIG. 2C is cross-section BB of the device.
Figure 3:
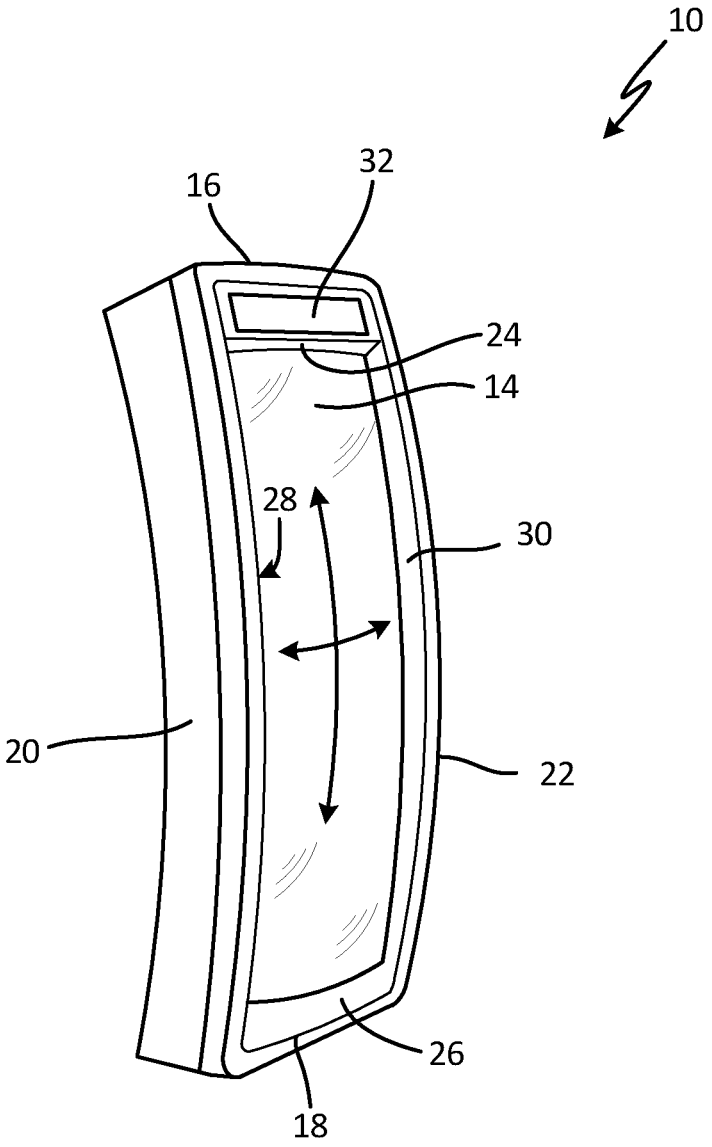
FIG. 3 is a perspective view of the device.

A front view of an embodiment of Privasee device 10 is shown in FIG. 2A. Device 10 comprises bilateral convex mirror 14 housed in a frame comprising top wall 16, bottom wall 18, left side wall 20 and right side wall 22. Section AA of the device shown in FIG. 2B, shows that the most forward extending point on the horizontal convex surface of the bilateral convex mirror is midway between left side wall 20 and right side wall 22. Section BB of the device shown in FIG. 2C, shows that the most forward extending point on the vertical convex surface of the bilateral convex mirror is midway between top wall 16 and bottom wall 18. A perspective view of Privasee device 10 shown in FIG. 3 shows the added feature of privacy shields 24, 26, 28 and 30 which are extensions of top wall 16, bottom wall 18, left side wall 20 and right side wall 22 that extend forward from bilateral convex mirror 14 to block the view of images in convex mirror 14 from observers positioned on each of side of user Ut or Us when positioned in front of a urinal. For further privacy, the inside surfaces of privacy shields 24, 26, 28 and 30 are coated with a non-reflective black finish. The vertical convex mirror and its specific design requirements can be placed on any standard height placement of a plumbing fixture. Use of device 10 with urinals or flushers for children and tall urinals or flushers for taller adults offers the same visual benefits.

As an added feature, optional sensor 32 (e.g. a motion sensor for automatic flushing purposes) may be incorporated in Privasee device 10. The width of the design allows the "Privasee" device 10 to be narrow enough to match existing structures of all flusher products currently in use and to still allow the user to observe a full width body image. Whether the individual user is 5-6 feet away or is close up during use, the image shown to the user is a maximum clear view of the urination process. An aspect of the horizontal convex mirror is that the image of the individual cannot be observed from any possible viewing angle by an unwanted observer. No images other than the individual user's image can be seen from any angle except that used by the individual user.

Figure 4:
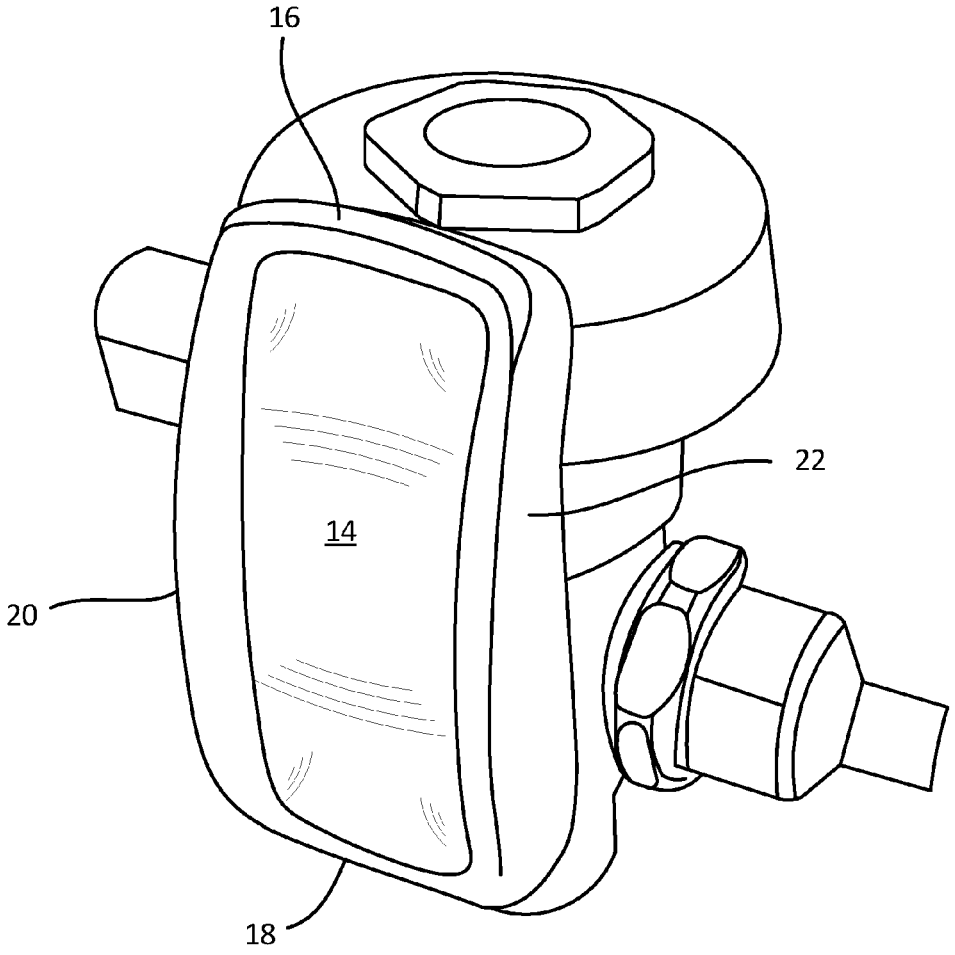
FIG. 4 is a photo of the device mounted on a urinal flusher.

As shown in FIG. 4, the device can be easily sized to fit any urinal plumbing fixture.

Figure 5A:
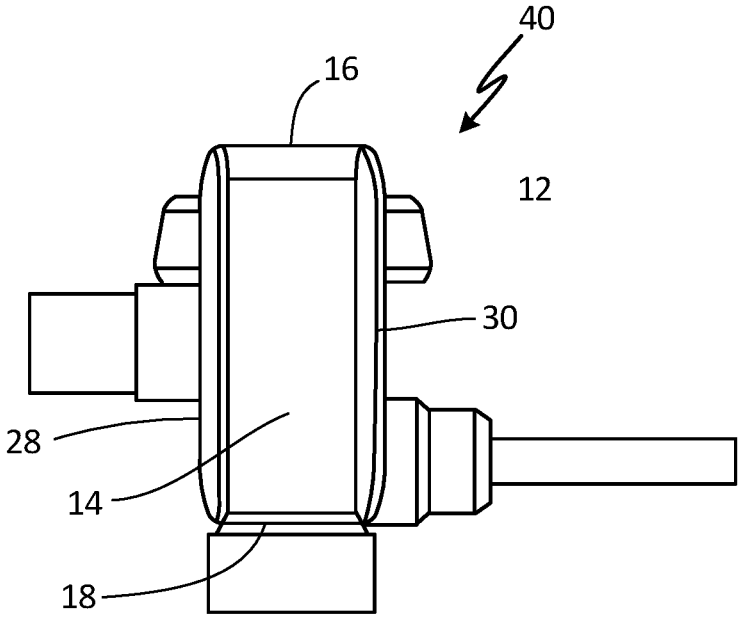
FIG. 5A is a front view of the device.
Figure 5B:
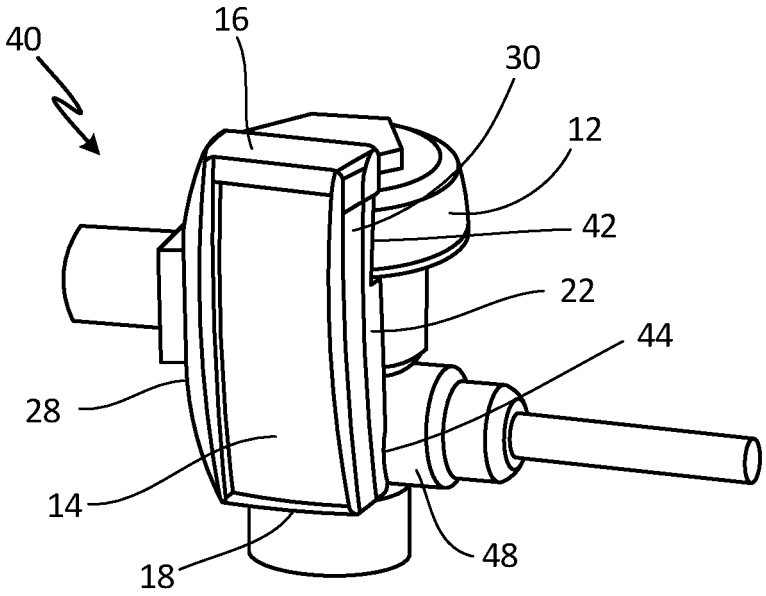
FIG. 5B is a perspective view of the device.
Figure 6A:
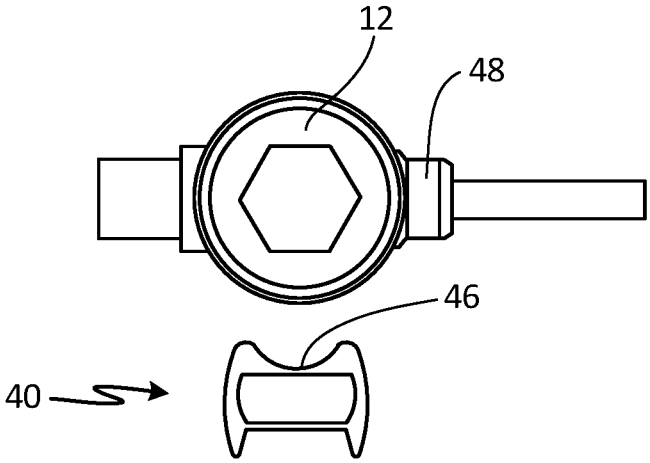
FIG. 6A is a top exploded view of the device.
Figure 6B:
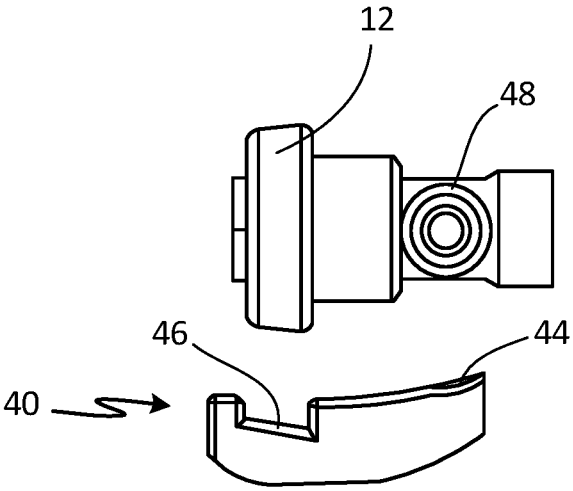
FIG. 6B is a side exploded view of the device.

In an embodiment, left side wall 20 and right side wall 22 may be configured to mate with and mount on flush valve 12 of a urinal as shown in FIGS. 5A and 5B. FIG. 5A is a front view of Privasee device 40 mounted on flush valve 12 showing bilateral convex mirror 14, top wall 16, bottom wall 18, left privacy shield 28 and right privacy shield 40. FIG. 5B is a perspective view of Privasee device 40 comprising left privacy shield 28 on left side wall 20 (not shown) and right privacy shield 30 on right side wall 22. The side walls are notched with notch 42 and scallop 44 in order to establish a close fit to flush valve 12 and flushing lever 48. FIGS. 6A and 6B are top and side views respectively of exploded Privasee device 40 and flush valve 12. Scallops 44 and 46 allow Privasee device 40 to closely fit on flush valve 12 providing a secure and attractive fixture.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A device comprising:

housing having a front with an aperture that forms a frame, an open back, a top wall, a bottom wall, a left side wall, and a right side wall; the open back, left side wall, and the right side wall being configured to mate with and mount to a flush valve of a urinal;

a bilateral convex mirror mounted in the frame;

a left privacy shield extending forward from the left side wall adjacent the bilateral convex mirror; and a right privacy shield extending forward from the right side wall adjacent the bilateral convex mirror.

2. The device of claim 1, wherein inside surfaces of the left and right privacy shields and the top and bottom walls are coated with a non-reflective black finish.

3. The device of claim 1, further comprising left and right side walls each include at least one notch for receiving a portion of the flush valve.

4. A device comprising:

housing having a front with an aperture that forms a frame, an open back, a top wall, a bottom wall, a left side wall, and a right side wall; the open back, left side wall, and the right side wall being configured to mate with and mount to a flush valve of a urinal; and a bilateral convex mirror mounted in the frame;

wherein a most forward extending point on a horizontal convex surface of the bilateral convex mirror is midway between the left and right side walls.

5. The device of claim 4, wherein a most forward extending point on a vertical convex surface of the bilateral convex mirror is midway between the top and bottom walls.

6. The device of claim 1, wherein the external surfaces of the housing have a chrome finish.

7. The device of claim 1 wherein the bilateral convex mirror is configured to allow a user of the urinal a clear vision of his private parts to aid in starting and maintaining a stream of urine that is deposited within the boundaries of the urinal.

8. A device comprising:

housing having a front with an aperture that forms a frame, an open back, a top wall, a bottom wall, a left side wall, and a right side wall; the open back, left side wall, and the right side wall being configured to mate with and mount to a flush valve of a urinal; and a bilateral convex mirror mounted in the frame;

wherein a most forward extending point on a vertical convex surface of the bilateral convex mirror is midway between the top and bottom walls.

* * * * *